US006540260B1

(12) United States Patent
Tan

(10) Patent No.: US 6,540,260 B1
(45) Date of Patent: Apr. 1, 2003

(54) PHOTOGRAPH ALBUM PAGE, SPINE AND SYSTEM

(76) Inventor: Whang Kwee Tan, 17 A. Ah Soo Garden, Singapore 539976 (SG)

( * ) Notice: Subject to any disclaimer, the term of this patent is extended or adjusted under 35 U.S.C. 154(b) by 0 days.

(21) Appl. No.: 09/770,424

(22) Filed: Jan. 26, 2001

Related U.S. Application Data

(63) Continuation-in-part of application No. 09/556,107, filed on Apr. 21, 2000, which is a continuation-in-part of application No. 09/497,837, filed on Feb. 3, 2000, now Pat. No. 6,135,663, and a continuation-in-part of application No. 09/394,466, filed on Sep. 11, 1999, now Pat. No. 6,109,647, and a continuation-in-part of application No. 09/369,708, filed on Aug. 6, 1999, now Pat. No. 6,142,696, and a continuation-in-part of application No. 09/350,612, filed on Jul. 9, 1999, now Pat. No. 6,056,494, and a continuation-in-part of application No. 09/234,222, filed on Jan. 20, 1999, now Pat. No. 5,997,041.

(51) Int. Cl.[7] ..... B42F 3/02

(52) U.S. Cl. ..... 281/22; 281/21.1; 281/42; 281/45; 281/51; 402/26; 402/36; 402/37; 402/38; 402/39; 402/40; 402/41; 402/42; 402/46; 402/70; 402/79; 40/379; 40/383; 40/400; 40/403; 40/405; 40/535; 40/536; 40/577; 40/773; 40/777; 40/779; 40/781

(58) Field of Search ..... 402/26, 36–42, 402/46, 70, 79; 281/21.1, 22, 42, 45, 51; 40/379, 383, 400, 403, 405, 535, 536, 577, 773, 777, 779, 781

(56) References Cited

U.S. PATENT DOCUMENTS

| | | | | | |
|---|---|---|---|---|---|
| 4,019,943 | A | * | 4/1977 | Holson | 156/227 |
| 4,048,740 | A | * | 9/1977 | Zitzelberger et al. | 40/158 |
| 4,426,007 | A | * | 1/1984 | Beleckis et al. | 40/379 |
| 4,447,973 | A | * | 5/1984 | Wihlke | 40/405 |
| 4,561,623 | A | * | 12/1985 | Shepherd et al. | 281/45 |
| 5,119,574 | A | * | 6/1992 | King | 281/21.1 |
| 5,186,497 | A | * | 2/1993 | Van Pinkerton, Jr. | 281/49 |
| 5,791,692 | A | * | 8/1998 | Manico et al. | 283/67 |
| 5,957,502 | A | * | 9/1999 | Manico et al. | 402/79 |
| 5,997,041 | A | * | 12/1999 | Tan | 281/21.1 |
| 6,004,061 | A | * | 12/1999 | Manico et al. | 402/79 |
| 6,108,952 | A | * | 8/2000 | Whittlef | 281/21.1 |
| 6,109,657 | A | * | 8/2000 | Tan | 281/20 |
| 6,135,663 | A | * | 10/2000 | Tan | 402/79 |
| 6,142,696 | A | * | 11/2000 | Tan | 402/26 |
| 6,253,475 | B1 | * | 7/2001 | Ruebens | 40/537 |
| 6,266,907 | B1 | * | 7/2001 | Matteau et al. | 40/776 |
| D449,854 | S | * | 10/2001 | Mochizuki | D19/32 |
| D455,457 | S | * | 4/2002 | Nakaji | D19/33 |
| 2001/0045041 | A1 | * | 11/2001 | Fu | 40/776 |

FOREIGN PATENT DOCUMENTS

| | | | |
|---|---|---|---|
| FR | 2636009 | * | 9/1988 |
| GB | 1184884 | * | 3/1970 |

* cited by examiner

*Primary Examiner*—A. L. Wellington
*Assistant Examiner*—Mark T. Henderson

(57) ABSTRACT

A photograph album system (10) has a spine (14) with an internal lateral groove (30) at one end and a removable retainer (42) having a plurality of internal retaining fingers (44) within the groove. A plurality of pages (52) are defined by a plurality of signatures (54). Each signature is defined by a plurality of page sets (56). Each page set consists of an interior support sheet (58) with a central fold (60) and a pair of exterior cover sheets (64). The exterior cover sheets are folded around an individual outer edge of an interior support sheet with each having a central fold defining an outer bend (66). The exterior cover sheets are adhered to the interior support sheet so that two pages are formed with separate pockets (72) on each side of each page. Posts (36) couple the pages to the spine.

9 Claims, 22 Drawing Sheets

FIG 3
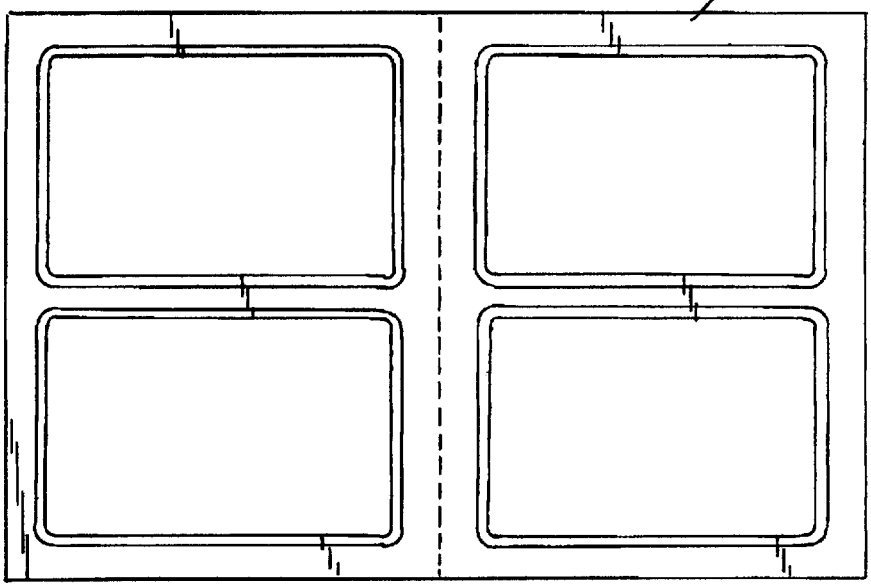
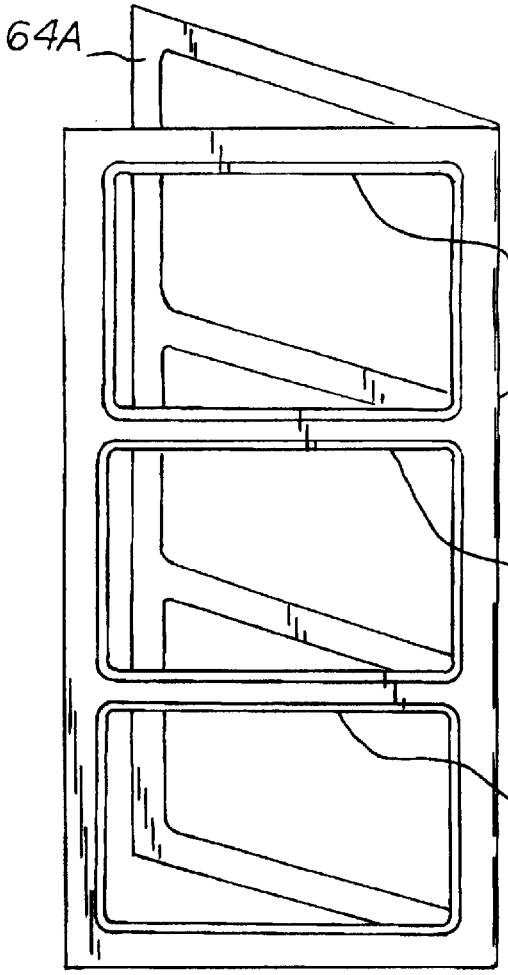
FIG 4A

FIG 7
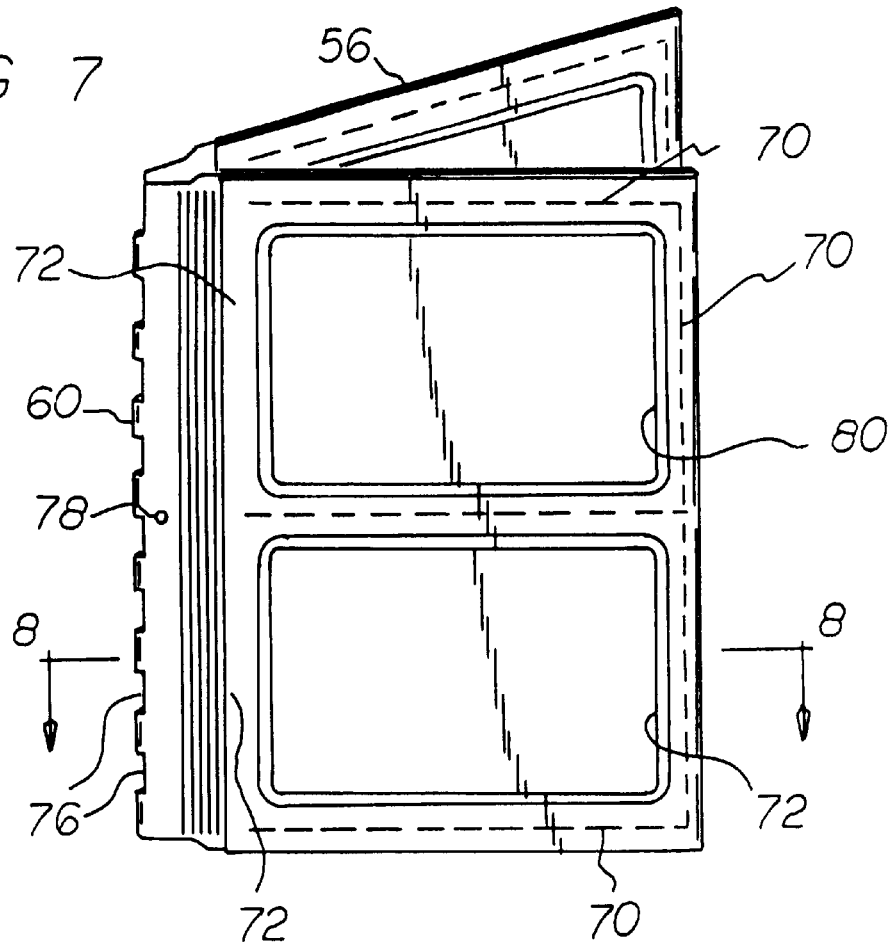
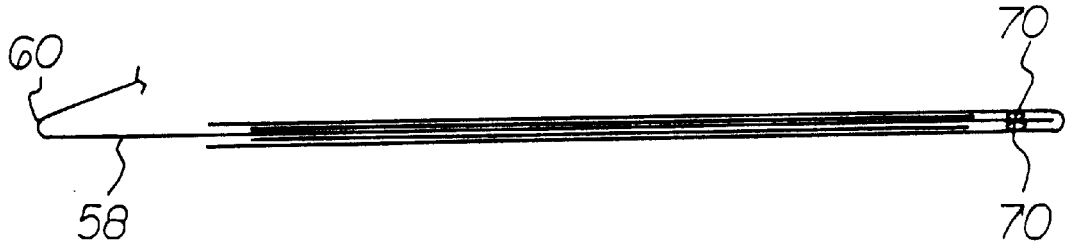
FIG 8

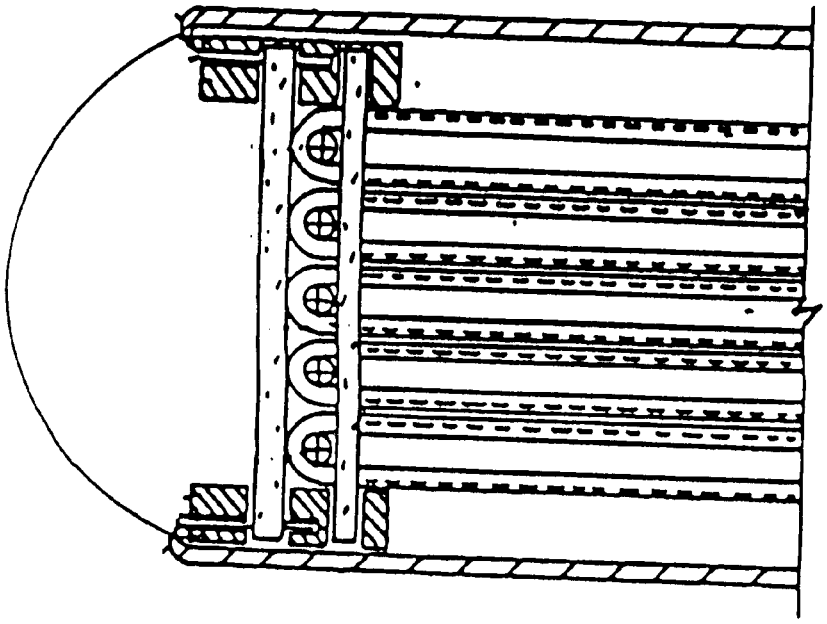
FIG 16
FIG 17A
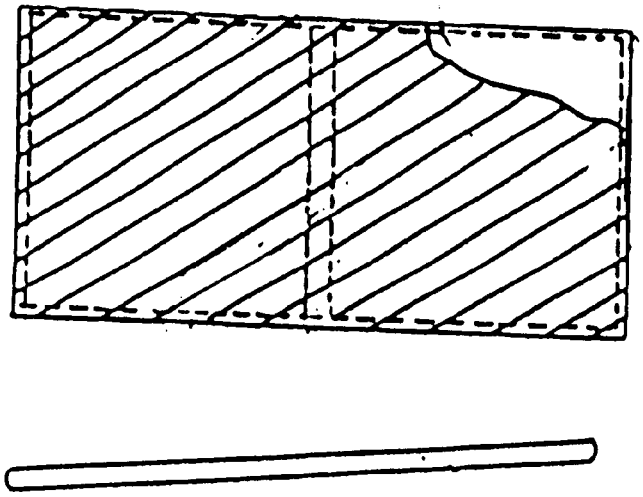
FIG 17B

FIG 21
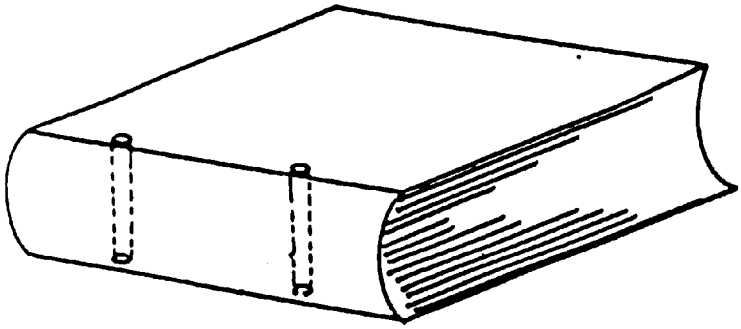
FIG 22
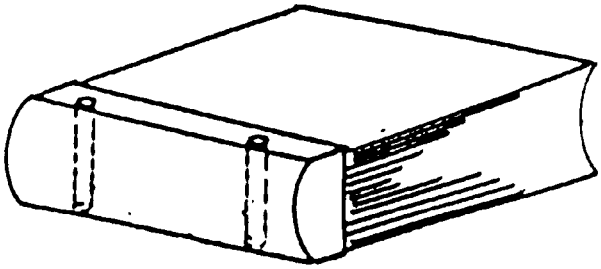
FIG 23
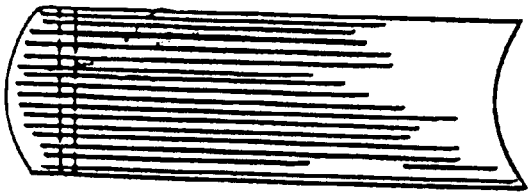
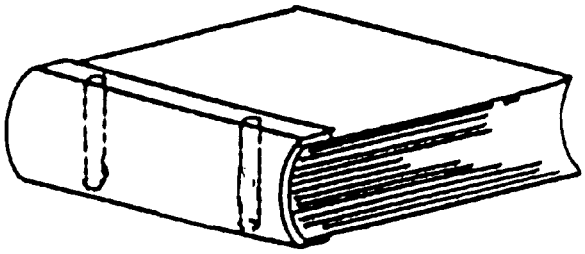
FIG 24

FIG 28
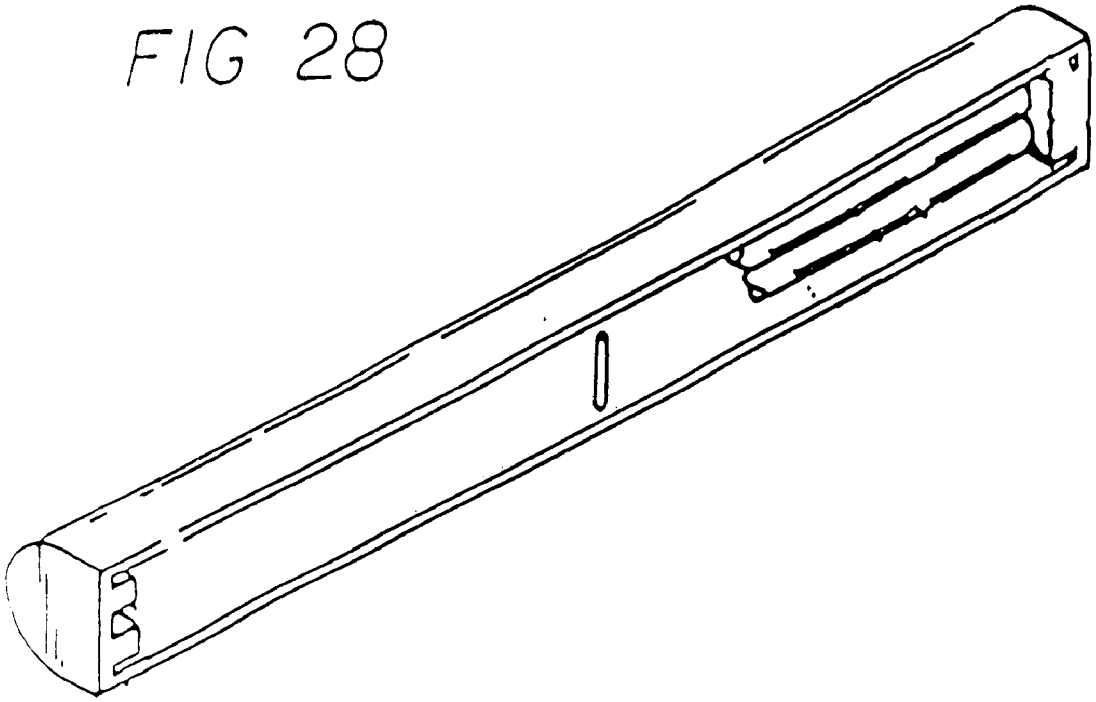
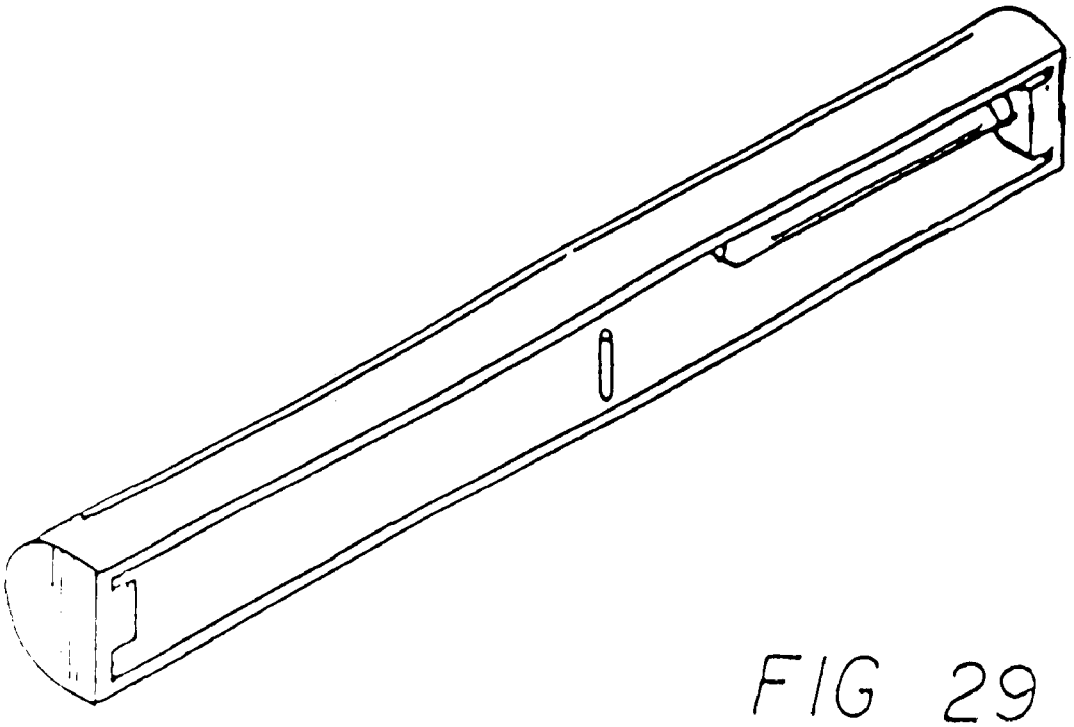
FIG 29

PHOTOGRAPH ALBUM PAGE, SPINE AND SYSTEM

RELATED APPLICATIONS

This application is a continuation-in-part of co-pending application Ser. No. 09/556,107 filed Apr. 21, 2000 which is in turn a continuation-in-part of application Ser. No. 09/394,466 filed Sep. 11, 1999 issued Aug. 29, 2000 as U.S. Pat. No. 6,109,647; Ser. No. 09/234,222 filed Jan. 20, 1999 issued Dec. 7, 1999 as U.S. Pat. No. 5,997,041; Ser. No. 09/350,612 filed Jul. 9, 1999 issued May 2, 2000 as U.S. Pat. No. 6,056,494; Ser. No. 09/369,708 filed Aug. 6, 1999 issued Nov. 7, 2000 as U.S. Pat. No. 6,142,696; and Ser. No. 09/497,837 filed Feb. 3, 2000 issued Oct. 24, 2000 as U.S. Pat. No. 6,135,663.

BACKGROUND OF THE INVENTION

1. Field of the Invention

The present invention relates to a photograph album page, spine and system and more particularly pertains to displaying photographs in an album with a unique spine and pages.

2. Description of the Prior Art

The use of photograph album pages and spines of known designs and configurations is known in the prior art. More specifically, photograph album pages and spines of known designs and configurations previously devised and utilized for the purpose of displaying photographs through a wide variety of methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,702,026 to Shaine discloses a method of making pages of a photo album. U.S. Pat. No. 5,242,522 to Moir discloses a method for producing a photo album page.

While these devices fulfill their respective, particular objectives and requirements, the aforementioned patents do not describe a photograph album page, spine and system allowing displaying photographs in an album with a unique spine and pages In this respect, the photograph album page, spine and system according to the present invention substantially departs from the conventional concepts and designs of the prior art, and in doing so provides an apparatus primarily developed for the purpose of allowing the assembly of the album with its unique spine and pages.

Therefore, it can be appreciated that there exists a continuing need for a new and improved photograph album page, spine and system which can be used for displaying photographs in an album with a unique spine and pages. In this regard, the present invention substantially fulfills this need.

SUMMARY OF THE INVENTION

In view of the foregoing disadvantages inherent in the known types of photograph album pages and spines of known designs and configurations now present in the prior art, the present invention provides an improved photograph album page, spine and system. As such, the general purpose of the present invention, which will be described subsequently in greater detail, is to provide a new and improved photograph album page, spine and system and method which has all the advantages of the prior art and none of the disadvantages.

To attain this, the present invention essentially comprises a photograph album system for removably receiving and supporting photographs and like image-bearing documents for maximized convenience and aesthetic appearance is comprised of a plurality of components in combination. First provided is a spine. The spine includes a pair of parallel side walls each with a top end and bottom end and an interior edge and exterior edge. The spine also includes top panel and a bottom panel. Each panel has an interior and exterior face. The top panel and bottom panel are each in parallel relationship with each other. The panels are coupled at the top of the walls and at the bottom of the walls for the receipt of pages there between. The two walls and two panels are in a rectilinear configuration. The resulting configuration has an open planar face from which pages may extend and a closed arcuate face opposite therefrom. The top panel has a fixed retainer portion with a front face and flush side walls. A plurality of recesses on the interior face of fixed retainer portion. An internal lateral groove is provided at the bottom end of each of the side walls adjacent to the bottom panel. An aperture is provided through each of the side walls at an intermediate location along a mid line of the sidewalls. Next provided are a plurality of cylindrical long posts. The long posts have opposite ends adapted to be received in the recesses. The retainer portion of the top panel of the spine is adapted for the receipt of the pages there around. A removable retainer is next provided. The removable retainer has an exterior face and a plurality of internal retaining fingers. The removable retainer is adapted to slidably couple in the groove of the spine and hold the cylindrical posts in an equally spaced configuration. Next provided is a short spine pin which passes through the side wall apertures to retain the posts in position within the spine. Lastly, a plurality of pages made from flexible paper products are provided. The plurality of pages are all defined by a plurality of signatures. The signatures are defined by a plurality of page sets. Each page set consists of an interior support sheet of a rectangular configuration having a central vertical fold defining an inner bend and a pair of outer edges. Each page set further has a pair of exterior cover sheets each having a central vertical fold positioned around an individual outer edge of the interior support sheet with each fold defining an outer bend and a pair of inner edges lying in proximity to the inner bend of the interior support sheet. The inner bend is adapted to hold a cylindrical long post. The exterior covers are adhered to the interior support sheet by glue on three sides such that two pages are formed with separate pockets on each side of each page with each pocket opening toward the inner edge of the exterior cover sheet and the inner bend of the interior support sheet. The interior support sheet initially has a generally rectangular configuration having a top and bottom edge and a pair of side edges and a central axis with a pair of recesses at the top and bottom edge thereof. The interior support sheet has a series of short rectangular apertures along the central axis to facilitate bending and a pair of circular apertures located equally spaced from the central axis along a mid line of the interior support sheet. The exterior cover sheets are initially of a rectangular configuration and have a plurality of rectangular apertures aligned along the central axis which serve to frame the photograph and like image-bearing document.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved photograph album page, spine and system which has all of the advantages of the prior art photograph album pages and spines of known designs and configurations and none of the disadvantages.

It is another object of the present invention to provide a new and improved photograph album page, spine and system which may be easily and efficiently manufactured and marketed.

It is further object of the present invention to provide a new and improved photograph album page, spine and system which is of durable and reliable constructions.

An even further object of the present invention is to provide a new and improved photograph album page, spine and system which is susceptible of a low cost of manufacture with regard to both materials and labor, and which accordingly is then susceptible of low prices of sale to the consuming public, thereby making such photograph album page, spine and system economically available to the buying public.

Even still another object of the present invention is to provide a photograph album page, spine and system for displaying photographs in an album with a unique spine and pages.

Lastly, it is an object of the present invention to provide a new and improved photograph album system having a spine with an internal lateral groove at one end and a removable retainer having a plurality of internal retaining fingers within the groove. A plurality of pages are defined by a plurality of signatures. Each signature is defined by a plurality of page sets. Each page set consists of an interior support sheet with a central fold and a pair of exterior cover sheets. The exterior cover sheets are folded around an individual outer edge of an interior support sheet with each having a central fold defining an outer bend. The exterior cover sheets are adhered to the interior support sheet so that two pages are formed with separate pockets on each side of each page. Posts couple the pages to the spine.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a front elevational view of the cover sheet shown in FIGS. 1 and 2 shown in a flat orientation.

FIGS. 4A, 4B, 4C and 4D are perspective illustrations similar to FIGS. 1 and 3 but illustrating an alternate embodiment with each page adapted to receive various numbers of photographs per face rather than two.

FIG. 7 is a perspective illustration of an assembled support sheet with two cover sheets mounted thereon to thereby form a page set.

FIG. 8 is a cross sectional view taken along line 8—8 of FIG. 7.

FIGS. 14 through 17 illustrate an alternate embodiment of the invention with a modified spine.

FIGS. 18 through 24 illustrate another alternate embodiment of the present invention with an additional modified spine construction.

FIGS. 28 through 30 illustrate yet another alternate embodiment of the invention with a further modified spine construction.

The same reference numerals refer to the same parts throughout the various Figures.

DESCRIPTION OF THE PREFERRED EMBODIMENT

Figure 1:
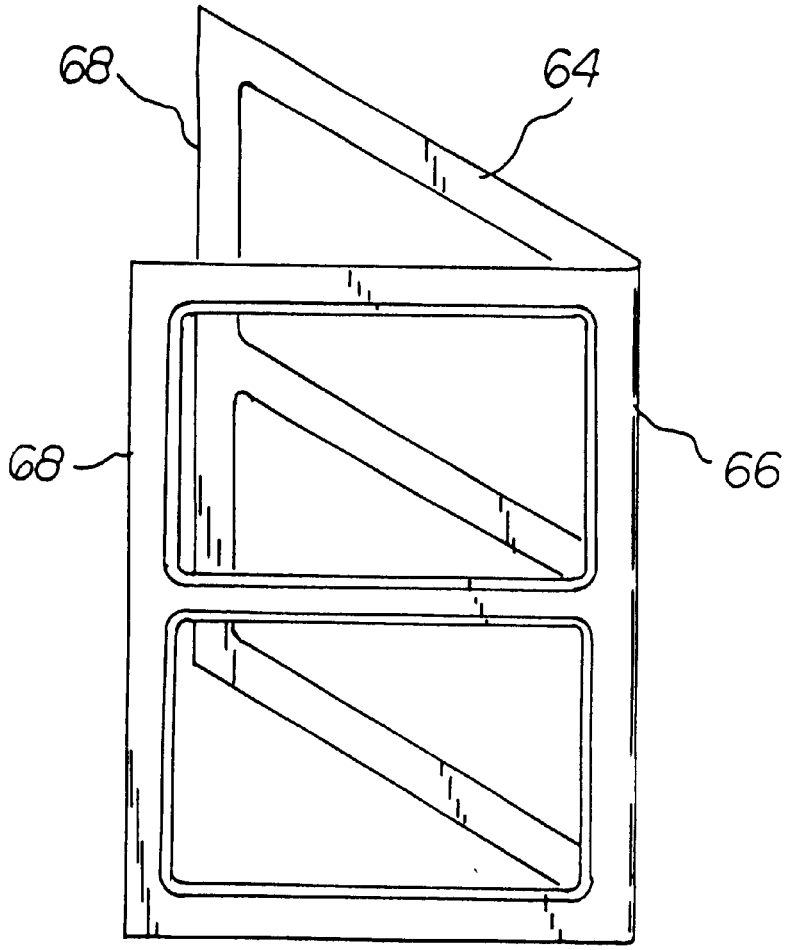
FIG. 1 is a perspective illustration of a cover sheet as used in constructing the pages of the present invention.
Figure 2:
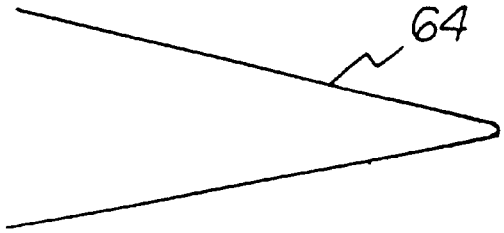
FIG. 2 is a top plan view of the cover sheet shown in FIG. 1.

With reference now to the drawings, and in particular to FIG. 1 thereof, the preferred embodiment of the new and improved photograph album page, spine and system embodying the principles and concepts of the present invention and generally designated by the reference numeral 10 will be described.

The present invention, the photograph album page, spine and system 10 is comprised of a plurality of components. Such components in their broadest context include a spine, a removable retainer, and a plurality of pages. Such components are individually configured and correlated with respect to each other so as to attain the desired objective.

A photograph album system 10 for removably receiving and supporting photographs and like image-bearing documents for maximized convenience and aesthetic appearance is comprised of a plurality of components in combination. First provided is a spine 14. The spine includes a pair of parallel side walls 16 each with a top end and bottom end and an interior edge and exterior edge. The spine also includes top panel 18 and a bottom panel 20. Each panel has an interior and exterior face. The top panel and bottom panel are each in parallel relationship with each other. The panels are coupled at the top of the walls and at the bottom of the walls for the receipt of pages therebetween. The two walls and two panels are in a rectilinear configuration. The resulting configuration has an open planar face 22 from which pages may extend and a closed arcuate face 24 opposite therefrom. The top panel has a fixed retainer portion 26 with a front face and flush side walls. A plurality of recesses 28 on the interior face of fixed retainer portion. An internal lateral groove 30 is provided at the bottom end of each of the side walls adjacent to the bottom panel. An aperture 32 is provided through each of the side walls at an intermediate location along a mid line of the sidewalls.

Next provided are a plurality of cylindrical long posts 36. The long posts have opposite ends adapted to be received in the recesses 28. The retainer portion of the top panel of the spine is adapted for the receipt of the pages there around.

A removable retainer 42 is next provided. The removable retainer has an exterior face and a plurality of internal retaining fingers 44. The removable retainer is adapted to slidably couple in the groove of the spine. After final assembly, the retainer is glued to hold the cylindrical posts in an equally spaced configuration.

Next provided is a short spine pin 48 which passes through the side wall apertures to retain the posts in position within the spine.

Lastly, a plurality of pages 52 made from flexible paper products are provided. The plurality of pages are all defined by a plurality of signatures 54, only one of which is shown. The signatures are defined by a plurality of page sets 56. Each page set consists of an interior support sheet 58 of a rectangular configuration having a central vertical fold defining an inner bend 60 and a pair of outer edges 62. Each page set further has a pair of exterior cover sheets 64 each having a central vertical fold positioned around an individual outer edge of the interior support sheet with each fold defining an outer bend 66 and a pair of inner edges 68 lying in proximity to the inner bend of the interior support sheet. The inner bend is adapted to hold a cylindrical long post. The exterior covers are adhered to the interior support sheet by glue 70 on three sides such that two pages are formed with separate passageways 72 on each side of each page with each passageway opening toward the inner edge of the exterior cover sheet and the inner bend of the interior support sheet. The interior support sheet initially has a generally rectangular configuration having a top and bottom edge and a pair of side edges and a central axis with a pair of recesses 74 at the top and bottom edge thereof. The interior support sheet has a series of short rectangular apertures 76 along the central axis to facilitate bending and a pair of circular apertures 78 located equally spaced from the central axis along a mid line of the interior support sheet. The exterior cover sheets are initially of a rectangular configuration and have a plurality of rectangular apertures 80 aligned along the central axis which serve to frame the photograph and like image-bearing document.

Figure 4B:
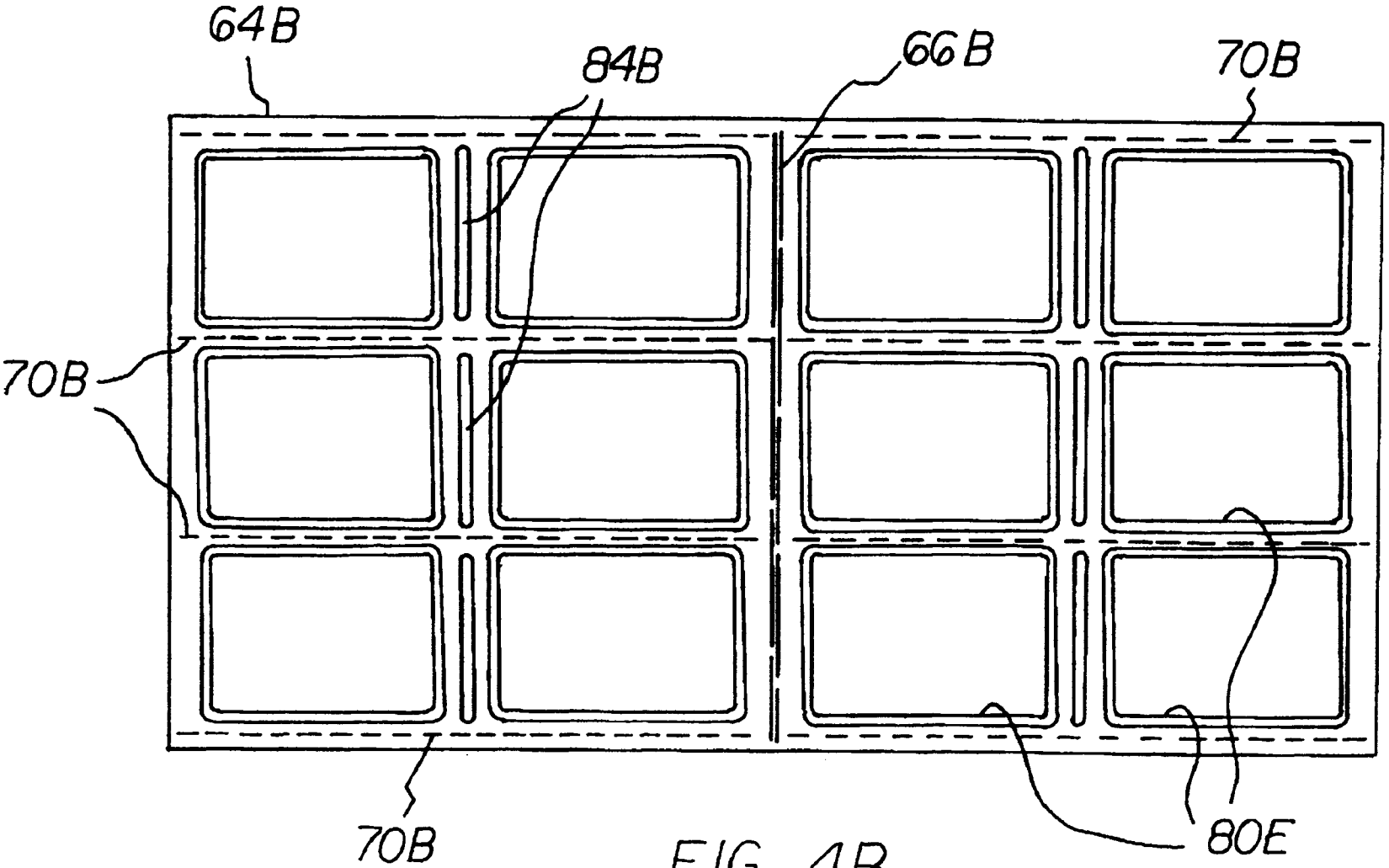
Figure 4C:
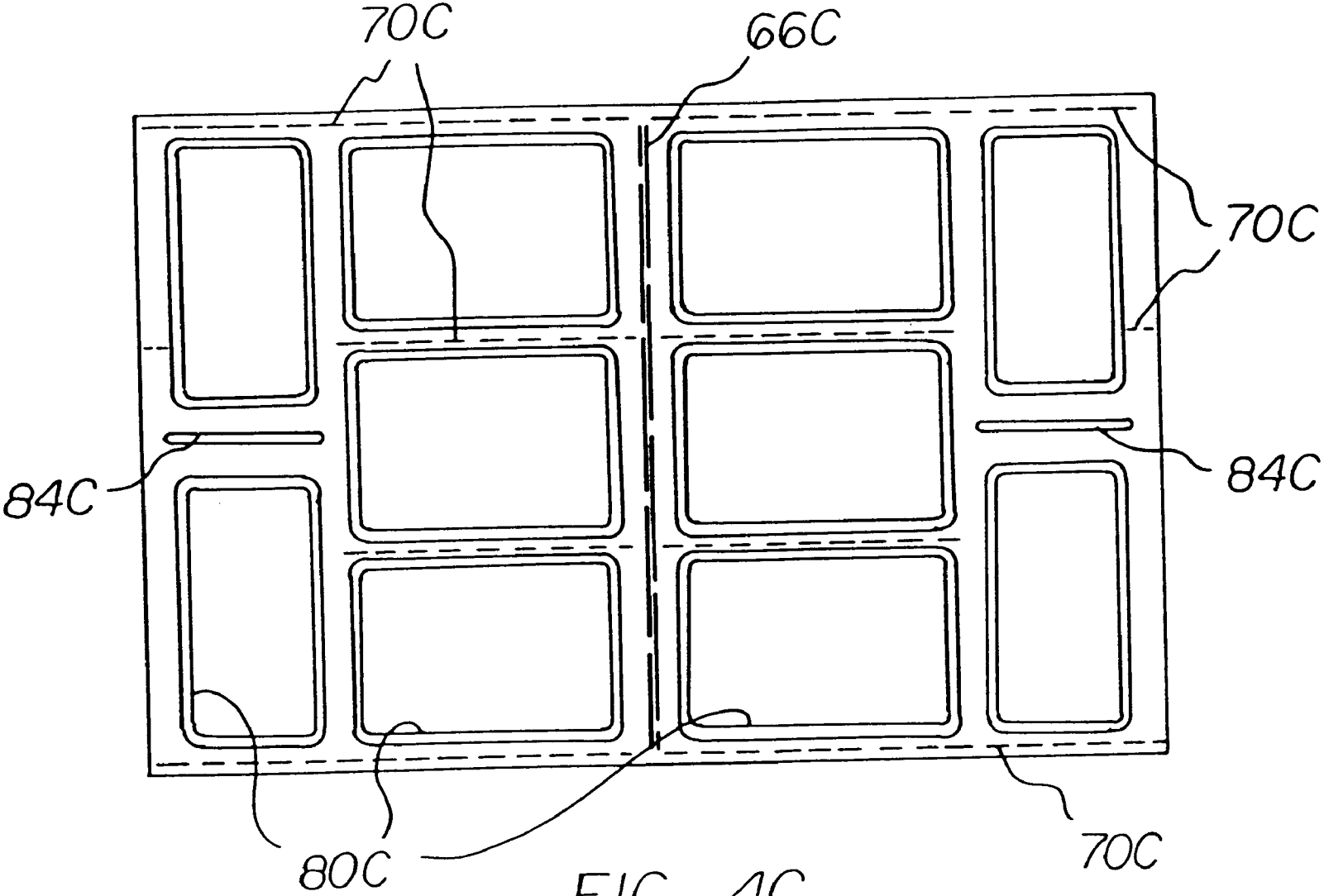
Figure 4D:
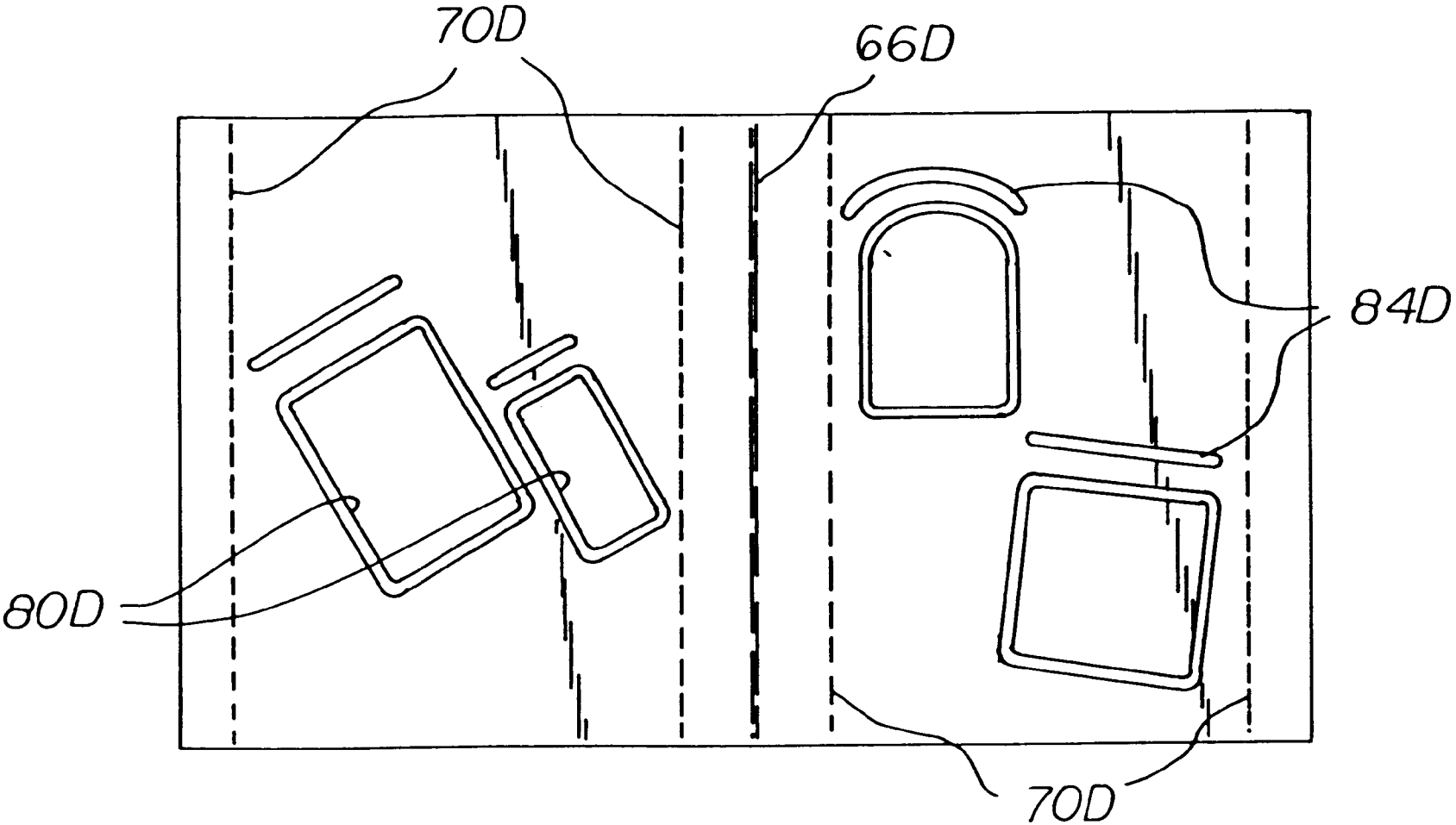
Figure 5:
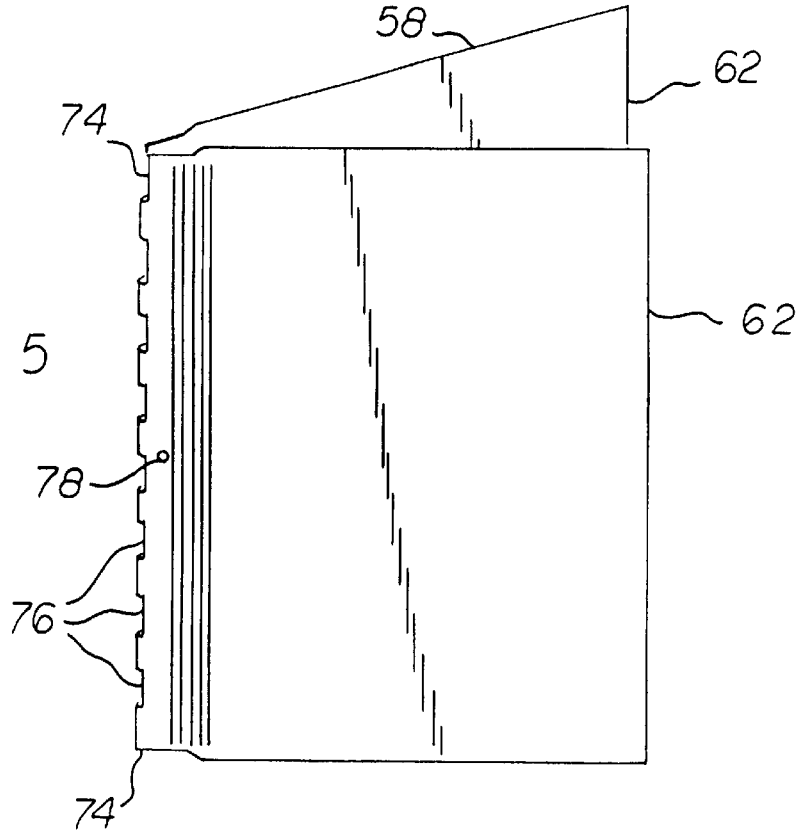
FIG. 5 is a perspective illustration of a support sheet utilized in association with the pages of the present invention.
Figure 6:
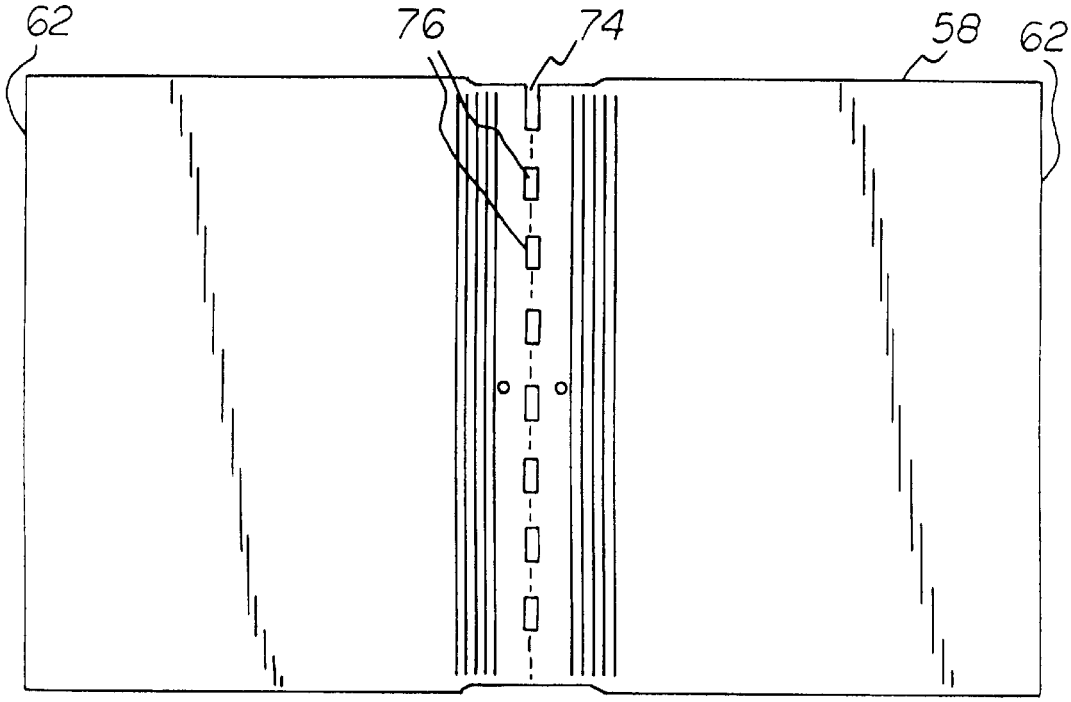
FIG. 6 is a front elevational view of the support sheet shown in FIG. 5 but in a flat orientation prior to folding.
Figure 9:
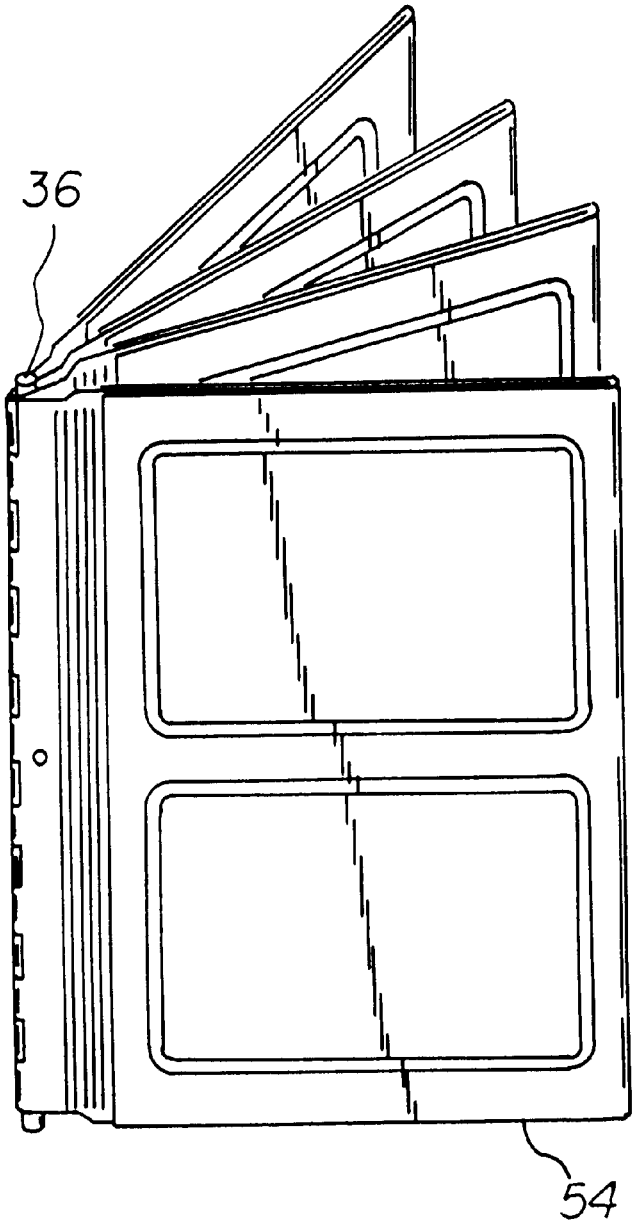
FIG. 9 is a perpsective illustration of two page sets assembled to form a single signature.
Figure 10:
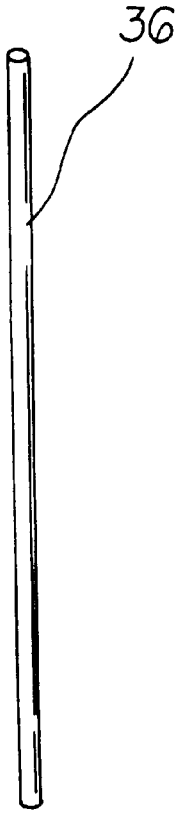
FIG. 10 is a perspective illustration of a long cylindrical support post for retaining a single signature as shown in FIG. 9.
Figure 11:
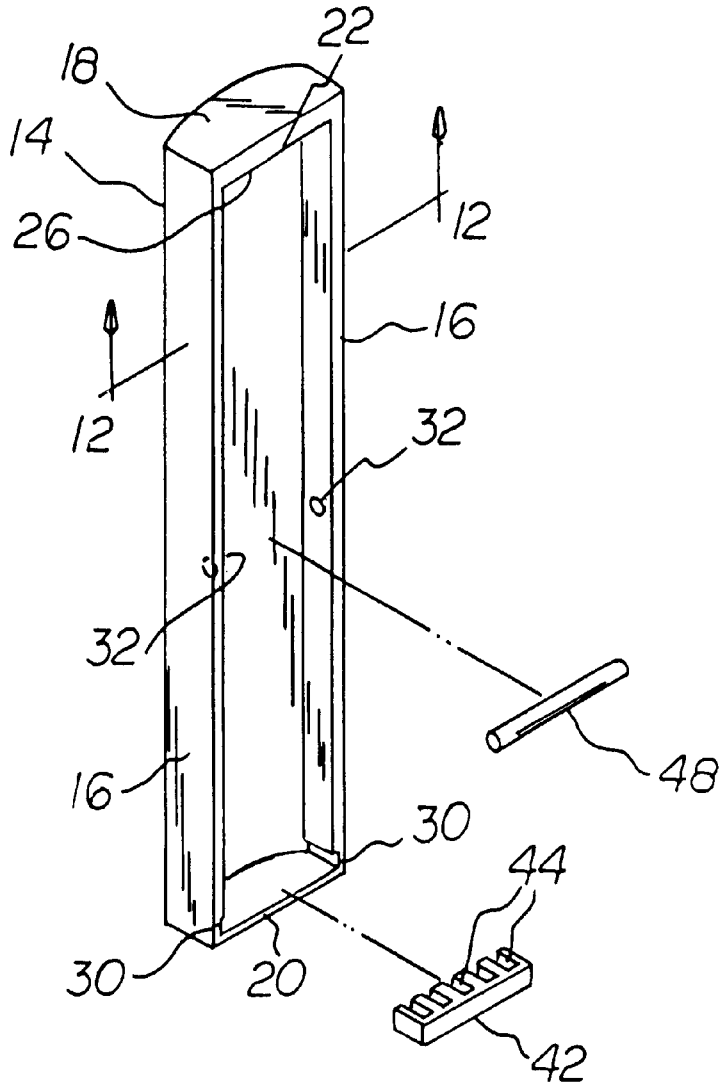
FIG. 11 is an exploded perspective illustration of a spine for supporting a plurality of signature.
Figure 12:
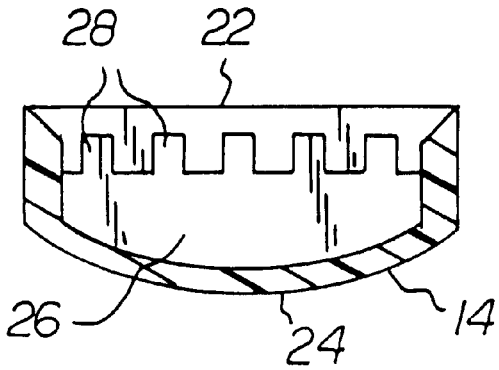
FIG. 12 is a cross sectional view taken along line 12—12 of FIG. 11.
Figure 13:
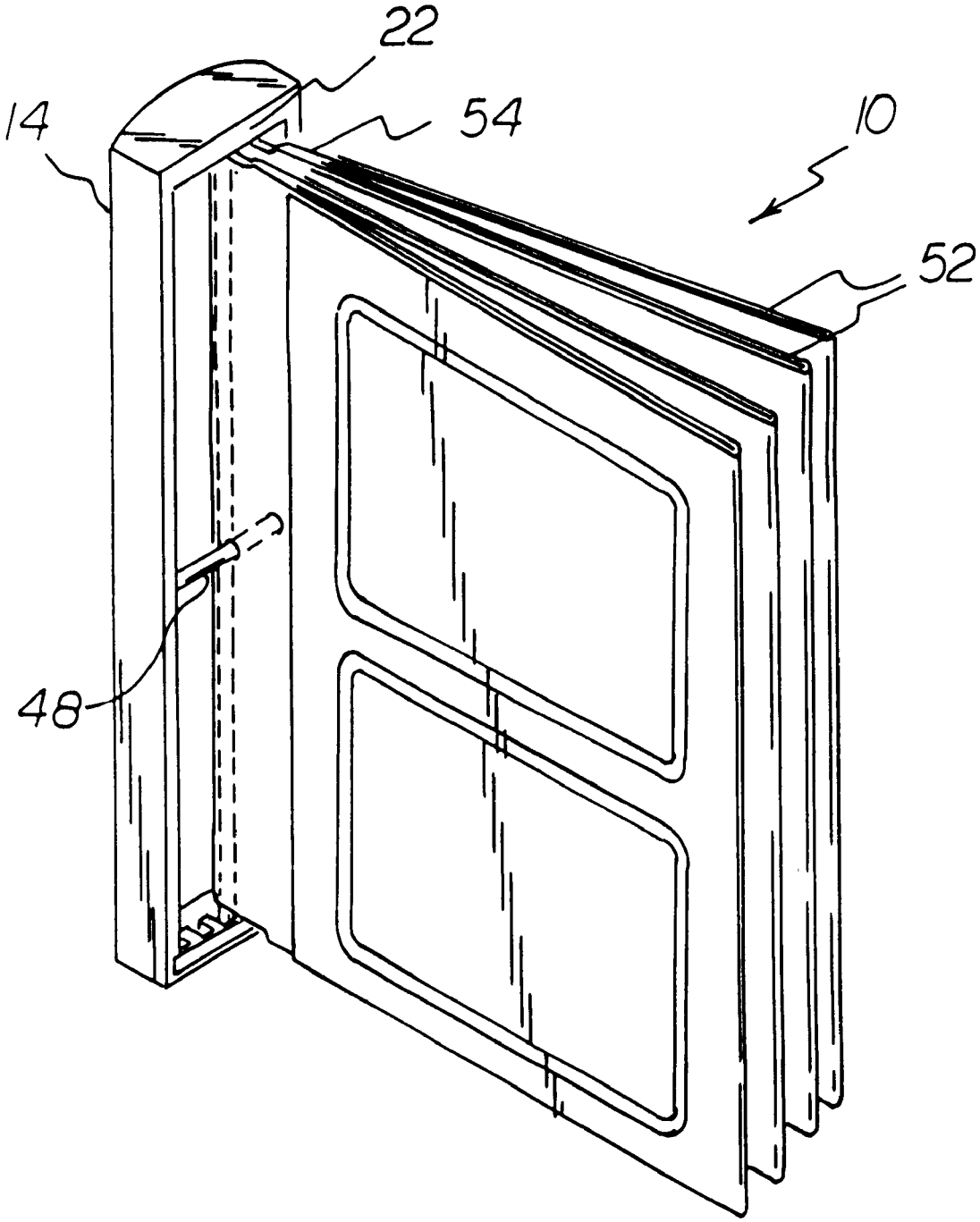
FIG. 13 is a perspective illustration of an assembled photograph album system but illustrating but only-one of the plurality of signatures in a mounted orientation.
Figure 14:
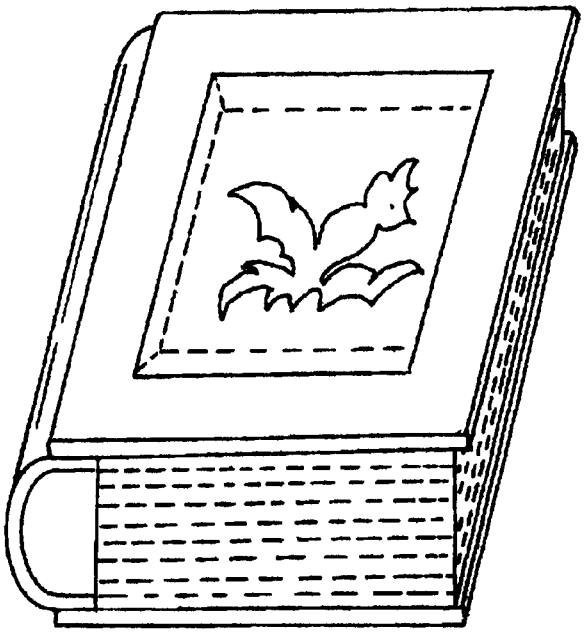
Figure 15:
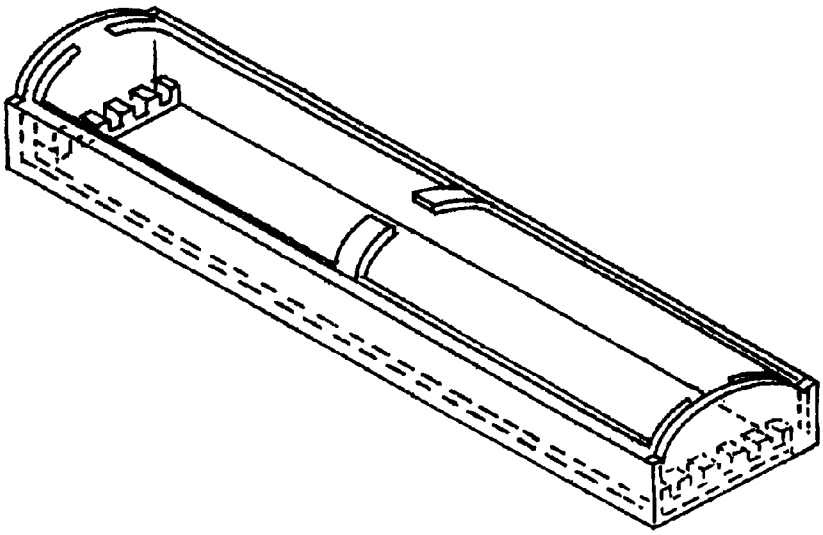
Figure 18:
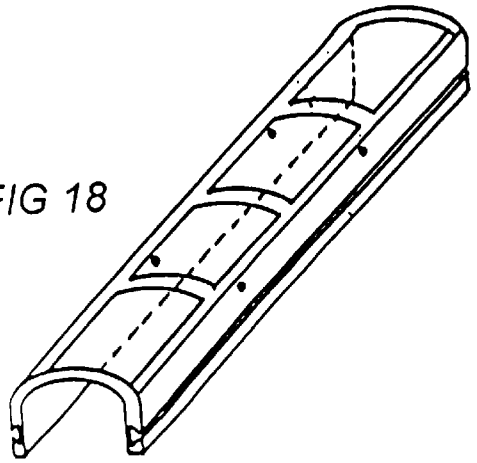
Figure 19:
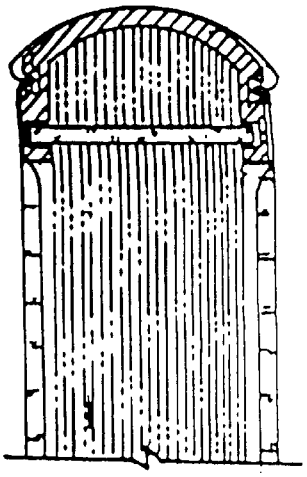
Figure 20:
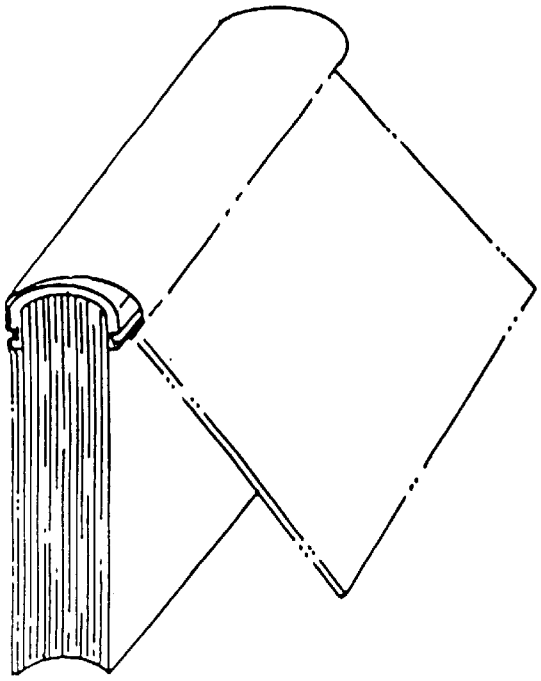

An alternate embodiment of the invention is shown in FIG. 4A wherein the cover sheets 64A are cut with openings 80A to receive six photographs per page set, three one each face of each page, on opposite sides of the fold line 80B. FIGS. 4B, 4C and 4D illustrate alternate constructions of the cover sheets 64B, 64C and 64D. In the FIG. 4B embodiment, the cover sheet 64B has six openings 80E on each side of the fold line 66B. Four horizontal glue lines 70B are above and below each opening. Insertion and removal of photographs is facilitated by vertical slots 84B between the laterally spaced openings of each face of each page. The FIG. 4C embodiment is cut to form three landscape oriented openings 80C on each side of the centerline 66C with glue lines 70C above and below, and with two portrait oriented openings laterally spaced therefrom. A horizontal slot 84C is located between the portrait oriented openings on each side for picture insertion and/or removal. The embodiment of FIG. 4D features openings 80D of various sizes and orientations on each side of the fold line 66D. Glue lines 70D are vertically positioned on opposite sides of the openings with slots 84D adjacent to each opening 80D for picture insertion and/or removal.

The present invention relates to a photograph album made with a special spine and special designed paper pages. The special spine is an improvement over the spines of our previous patent applications. Such improvement enables easier and smoother assembly.

The special pages are preferably made from paper, which will give the photograph album a sense of value because most of the high-end photograph albums are associated with paper. Low-end photograph albums are associated with plastic pockets.

The album pages actually look like paper frames. The whole album is, therefore, consisted of a number of paper frames together with a cover. There are some processes needed to be done before the pages could be assembled together to become a photograph album.

The paper pages are made up of three components, one centerpiece or support sheet and two frame pieces or cover sheets. To produce the support sheet, one piece of paper is die-cut with rectangular holes along the centerline with pressed lines on the two sides of the rectangular spots. The support sheet is then folded along the center to become two pages with the center attached. The purpose to have die-cut rectangular holes is to align the pages and to make the pages more straight during assembling the pages into the album.

To make the cover sheets, two pieces of identical size paper are needed, the two pieces of page are then die-cut into frames, the size and the number of cover sheets on each page is determined by the size and number of photographs the album is designed to accommodate. Each of the papers with the die-cut cover sheets is folded symmetrically to create two pages with the center attached.

The next step is to apply adhesive on the die-cut cover sheets. It is important that the amout of adhesive applied will not block the inserting of the pictures, so only an adequate amount will do. It is important to note that the adhesive will only be applied horizontally by an automatic dispenser. This dispenser will apply adhesive in a linear form making production effectively and efficiently. The next step is to combine the cover sheet and the support sheet together to form the complete page.

The pages are then hung onto poles, preferably two pages per pole to form a signature. As mentioned earlier, there are die-cut indentations along the center of the centerpiece. If two identical pages are stacked together without the die-cut indentations, the pages will not be straight and aligned because of the thickness. With the die-cut indentations, however, the pages will tend to be aligned and straight if the die-cut portions of the page allow the other non die cut portions of the page to slot in. The next step is to insert a pole vertically into the pages to lock and keep the pages and the poles together.

The pages are to be installed into a specially designed spine holder. This holder is an improvement of the previous spine of our prior patent applications. The spine holder is, preferably, made by injection moldings. There are actually two separate units to this holder, one part for holding the pages and the other is for locking the pages. Once the pages are installed into the holding part of the holder, the locking part of the holder will then lock the pages from falling out.

The holder has two long parallel walls and two short parallel walls. One side of the holder is enclosed shaped like an arc or made with a plurality of bridges in-between the two long walls running parallel with the two short walls to save material. The enclosed side or the bridges are used to keep the poles with pages in position and not to fall out of the holder. There are some indented slots in one of the short walls for the holding of the pages. There are indented slots on the locking part as well. They serve the same function to hold and keep the poles with pages in position.

It should be understood that the primary embodiment of the present invention includes a new and useful and unobvious spine construction as well as a new and useful and unobvious page construction. It should be understood that the spine is adapted to receive a wide variety of pages. Additionally, a wide variety of spines could be used with the pages.

An alternate embodiment of the invention is illustrated in FIGS. 14 through 17. In this embodiment the spine is modified to receive pages as described in the primary embodiment.

Still another alternate embodiment with an additional modified spine is shown in FIGS. 18 through 24.

Figure 25:
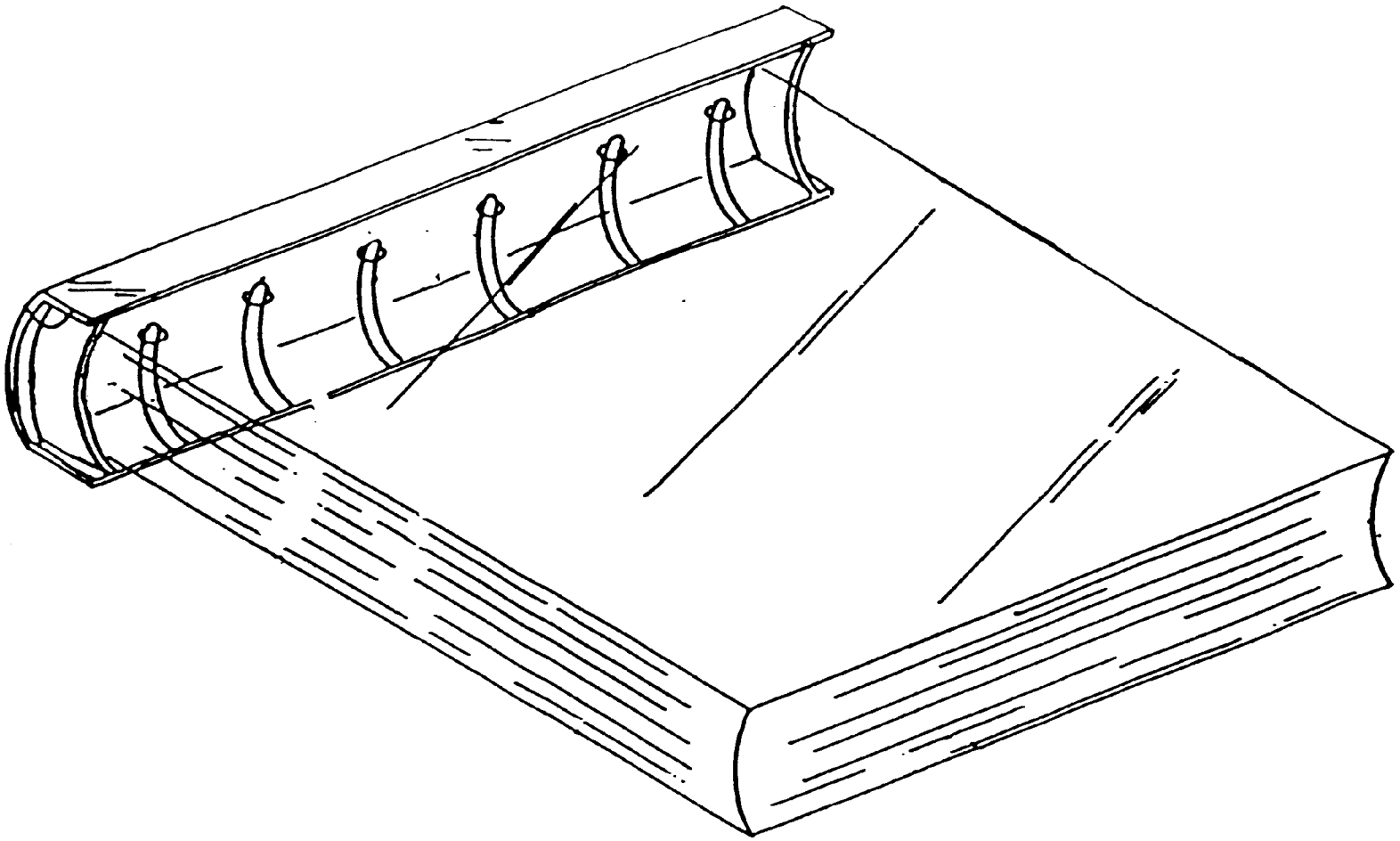
FIGS. 25 through 27 illustrate yet another alternate spine construction adapted to be utilized in association with the pages of the present invention.
Figure 26:
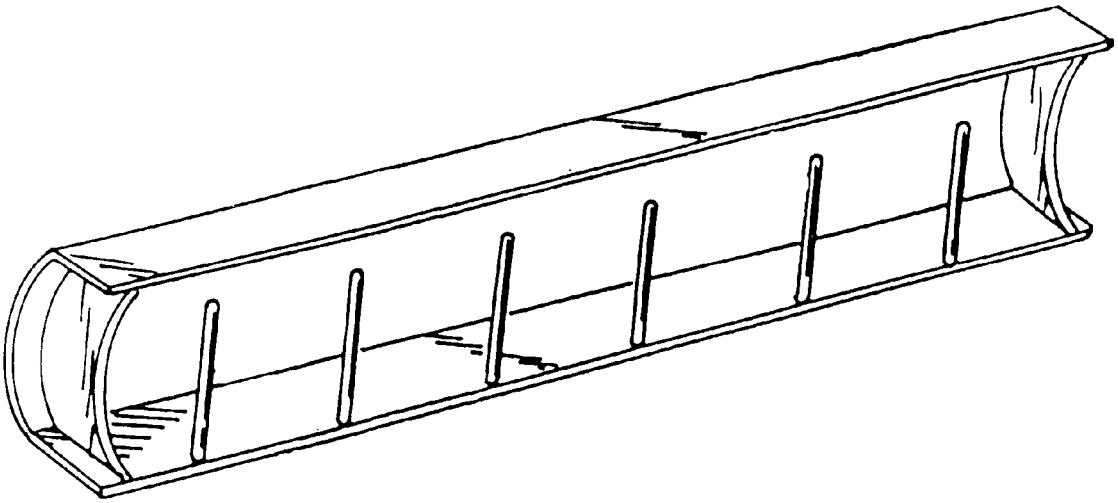
Figure 27:
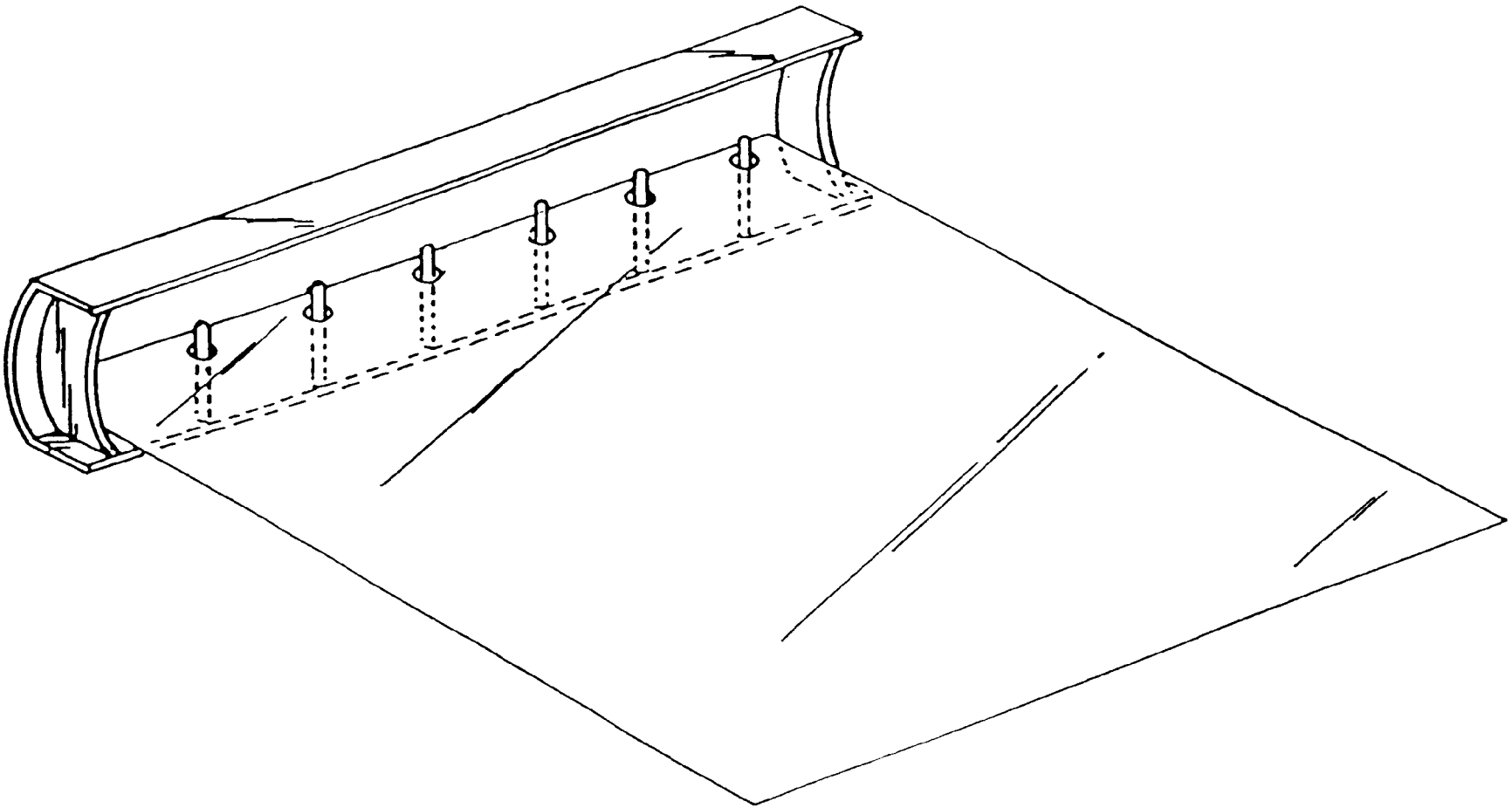

Yet another alternate spine construction adapted to be utilized in association with the pages of the present invention is shown in FIGS. 25 through 27.

Figure 30:
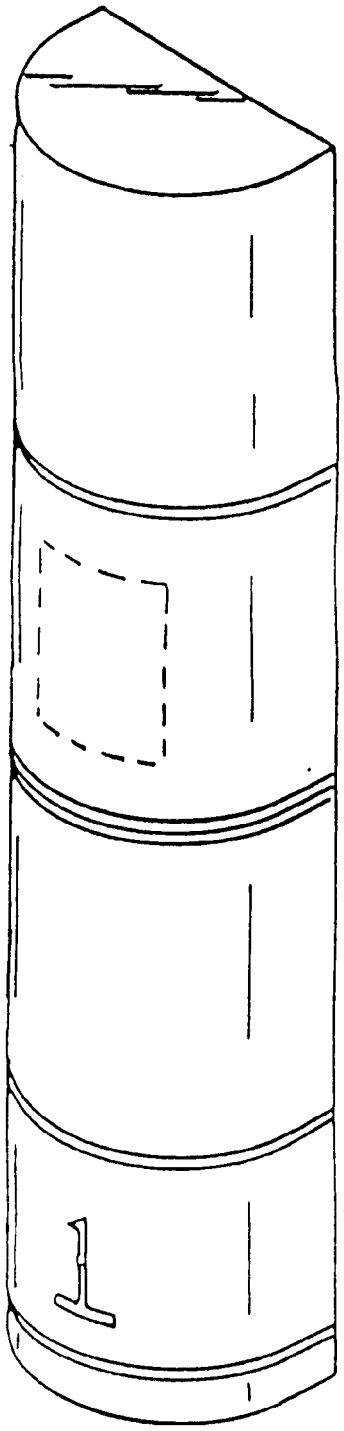

Even yet another further modified spine construction is shown in another alternate embodiment of the invention in FIGS. 28 through 30.

Figure 31:
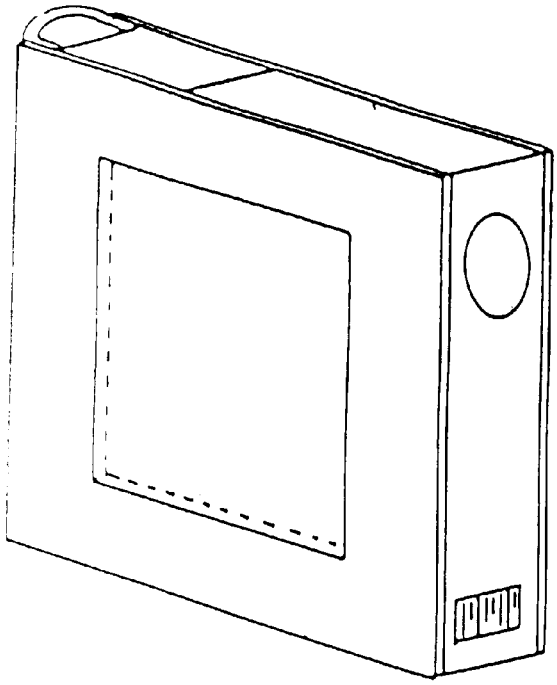
FIGS. 31 through 33 illustrate a packaging system adapted to be utilized in association with the photograph album system of the present invention along with a modified page.
Figure 33:
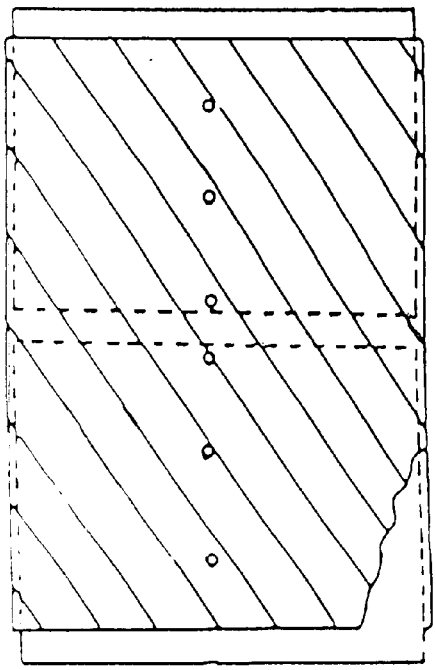
Figure 32:
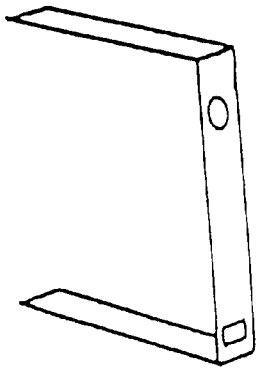
Figure 34:
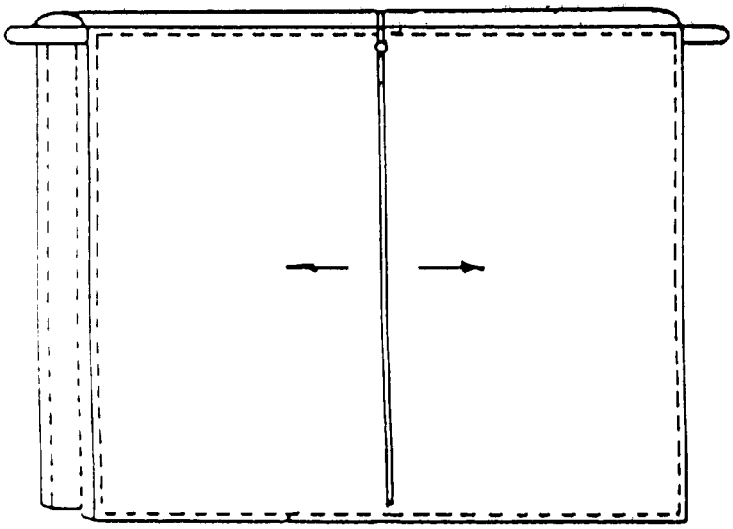
FIGS. 34 through 37 illustrate a cover and page construction capable of being utilized in association with the photograph album system of the present invention.
Figure 35:
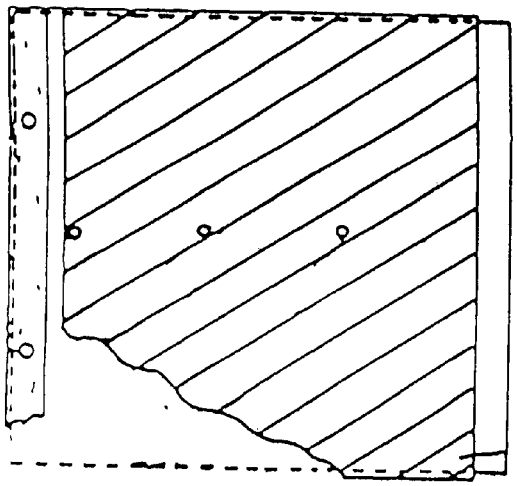
Figure 36:
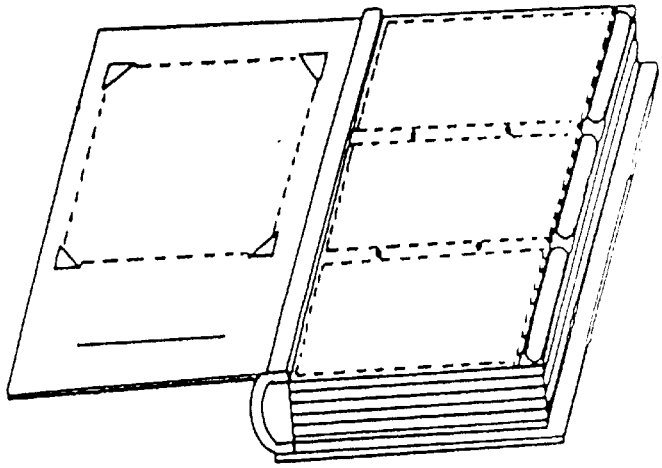
Figure 37:
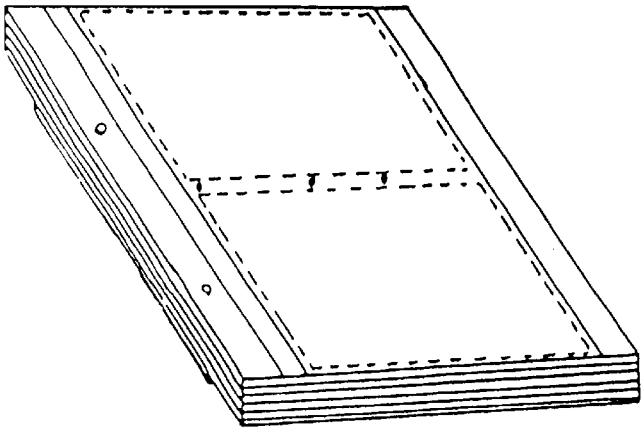

A packaging system adapted to be utilized in association with the photograph album system of the present invention is shown in FIGS. 31 through 33 along with a modified page.

A cover and page construction capable of being utilized in association with the photograph album system of the present invention is shown in FIGS. 34 through 37. Such cover, as well as the pages of FIGS. 17A, 33 and 35, could be utilized with the spine as described in the primary embodiment.

Further details of construction for these alternate embodiments to spine constructions, packaging arrangements, and supplemental covers may be had in greater detail by reference to copending U.S. patent application Ser. No. 09/556,107 filed Apr. 21, 2000 and U.S. Pat. No. 6,109,657, as well as the patent applications and patents thereof as recited herein above, the subject matter of which is incorporated there in by reference.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A photograph album system for removably receiving and supporting photographs and image-bearing documents for maximized convenience and aesthetic appearance comprising, in combination:

a spine including a pair of parallel side walls each with a top end and bottom end and an interior edge and exterior edge, the spine also including two panels, a top panel and a bottom panel each with an interior and exterior face, the top panel and bottom panel each being in parallel relationship with each other and coupled at the top of the walls and at the bottom of the walls for the receipt of pages there between, the two walls and two panels being in a rectilinear configuration with an open planar face from which pages may extend and a closed arcuate face opposite therefrom, the top panel having a fixed retainer portion with a front face flush side walls, the side walls each having an internal lateral groove at the bottom end thereof adjacent to the bottom panel, and the side walls each have an aperture there through at an intermediate location along a mid line of the side walls thereof;

a plurality of cylindrical long posts having opposite ends adapted to be received in the recesses the retainer portion of the top panel of the spine adapted for the receipt of the pages there around;

a removable retainer having an exterior face and plurality of internal retaining fingers, the removable retainer adapted to slidably couple in the groove of the spine and hold the cylindrical posts in an equally spaced configuration;

a short spine pin passing through the side wall apertures to retain the posts in position within the spine; and a plurality of pages all being made from flexible paper products with the plurality of pages all being defined by a plurality of signatures, the signatures being defined by a plurality of page sets, each page set consisting of an interior support sheet of a rectangular configuration having a central vertical fold defining an inner bend and a pair of outer edges, each page set further having a pair of exterior cover sheets each having a central vertical fold positioned around an individual outer edge of the interior support sheet with each fold defining an outer bend and a pair of inner edges lying in proximity to the inner bend of the interior support sheet, the inner bend being adapted to hold a cylindrical long post, the exterior covers being adhered to the interior support sheet by glue on three sides such that two pages are formed with separate pockets on each side of each page with each pocket opening toward the inner edge of the exterior cover sheet and the inner bend of the interior support sheet, the interior support sheet initially having a generally rectangular configuration having a top and bottom edge and a pair of side edges and a central axis with a pair of recesses at the top and bottom edge thereof, the interior support sheet having a series of short rectangular apertures along the central axis to facilitate bending and a pair of circular apertures located equally spaced from the central axis along a mid line of the interior support sheet, the exterior cover sheets initially being of a rectangular configuration and having a plurality of rectangular apertures 80 aligned along the central axis which serve to frame the photograph and like image-bearing document.

2. A photograph album system comprising:

a spine having a fixed retainer at one end thereof and a removable retainer having a plurality of internal retaining fingers at the other end with a plurality of cylindrical posts received in the spine;

a plurality of pages defined by a plurality of signatures, each signature being defined by a plurality of page sets, each page set consisting of at least one interior support sheet with an outer edge and an associated exterior cover sheet being folded around the outer edge of the interior support sheet with each exterior cover sheet having a central fold defining an outer bend; and posts coupling the pages to the spine.

3. The invention as set forth in claim 2 wherein all of the pages are made from flexible paper products.

4. The invention as set forth in claim 2 wherein the exterior cover sheet of each page set is adhered to the interior support by glue along three edges.

5. A photograph album system comprising:

a spine;

a plurality of pages defined by a plurality of signatures, each signature being defined by a plurality of page sets, each page set consisting of an interior support sheet having a central fold and exterior cover sheets each being folded around an individual outer edge of interior support sheet with each having a central fold defining an outer bend, the exterior cover sheets being adhered to the interior support sheet such that two pages are formed with separate pockets on each side of each page; and posts coupling the pages to the spine.

6. The invention as set forth in claim 5 wherein the spine includes a top panel having a fixed retainer portion with a plurality of recesses and a removable retainer having a plurality of internal retaining fingers and page supporting posts between the recesses and fingers.

7. The invention as set forth in claim 5 wherein the spine includes side walls with an aperture there through at an intermediate location along a midline thereof, the plurality of page sets having a pair of circular apertures located equally spaced from a central axis along a midline of an interior support and a short spine pin to retain the posts in position within the spine.

8. The invention as set forth in claim 2 wherein the cover sheet and support sheet are coupled by glue lines with passageways adjacent to center folds of the cover sheet for the passage of photographs.

9. The invention as set forth in claim 2 wherein the cover sheets and support sheets are coupled by glue lines and with slots in the cover sheets for the passage of photographs.

* * * * *